US007446466B2

(12) United States Patent
Chen

(10) Patent No.: US 7,446,466 B2
(45) **Date of Patent: *Nov. 4, 2008**

(54) FIELD EMISSION LIGHT SOURCE

(75) Inventor: Ga-Lane Chen, Guangdong (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 429 days.

This patent is subject to a terminal disclaimer.

(21) Appl. No.: 11/164,774

(22) Filed: Dec. 5, 2005

(65) Prior Publication Data

US 2006/0197427 A1 Sep. 7, 2006

(30) Foreign Application Priority Data

Dec. 8, 2004 (CN) ..... 2004 1 00774174

(51) Int. Cl.
*H01J 9/02* (2006.01)

(52) U.S. Cl. ..... 313/495; 313/310; 313/311

(58) Field of Classification Search ..... 313/495, 313/497, 309, 310, 311, 339, 351
See application file for complete search history.

(56) References Cited

U.S. PATENT DOCUMENTS

| | | | | |
|---|---|---|---|---|
| 5,493,143 | A * | 2/1996 | Hokari | 257/432 |
| 5,559,389 | A * | 9/1996 | Spindt et al. | 313/310 |
| 5,801,477 | A * | 9/1998 | Macaulay | 313/309 |
| 5,925,891 | A * | 7/1999 | Koga et al. | 257/10 |
| 6,204,596 | B1 * | 3/2001 | Macaulay et al. | 313/310 |
| 6,646,282 | B1 | 11/2003 | Chen | |
| 6,710,551 | B2 | 3/2004 | Mita et al. | |
| 6,750,616 | B2 | 6/2004 | Chen | |
| 6,750,617 | B2 | 6/2004 | Chen | |
| 6,781,327 | B2 | 8/2004 | Ohsawa | |
| 6,815,877 | B2 | 11/2004 | Chen | |
| 6,825,607 | B2 | 11/2004 | Chen | |
| 6,825,608 | B2 | 11/2004 | Chen | |
| 6,838,814 | B2 | 1/2005 | Chen | |
| 2005/0067935 | A1 * | 3/2005 | Lee et al. | 313/309 |

FOREIGN PATENT DOCUMENTS

| | | | |
|---|---|---|---|
| CN | 1280382 | A | 1/2001 |
| CN | 1467783 | A | 1/2004 |

OTHER PUBLICATIONS

Mirko Croci et al., "A fully sealed luminescent tube based on carbon nanotube field emission.", Microelectronics Journal, 2004, pp. 329-336.

* cited by examiner

*Primary Examiner*—Ashok Patel
(74) *Attorney, Agent, or Firm*—Winston Hsu

(57) ABSTRACT

A field emission light source (100) includes: a cathode (111); a nucleation layer (112) formed on the cathode; a field emission portion (102) formed on the nucleation layer; and a light-permeable anode (117) arranged over the cathode. The field emission portion includes an isolating layer (113) formed on the cathode; a plurality of isolating posts (114) disposed on the isolating layer; and a plurality of field emitters (115) located on the respective isolating posts. The field emitters contain molybdenum. The isolating posts contain silicon carbon. Preferably, the field emitter has a diameter ranging from about 0.5 nanometers to 10 nanometers.

12 Claims, 4 Drawing Sheets

FIELD EMISSION LIGHT SOURCE

CROSS-REFERENCES TO RELATED APPLICATION

This application is related to a first copending U.S. utility patent application Ser. No. 11/287,008, entitled "A BACKLIGHT DEVICE USING A FIELD EMISSION LIGHT SOURCE" filed on Nov. 23, 2005, a second copending U.S. utility patent application Ser. No. 11/306,211, entitled "A FIELD EMISSION LIGHT SOURCE" filed on Dec. 20, 2005, a third copending U.S. utility patent application Ser. No. 11/306,209, entitled "BACKLIGHT DEVICE USING FIELD EMISSION LIGHT SOURCE" filed on Dec. 20, 2005, which is entirely incorporated herein by reference.

FIELD OF THE INVENTION

The present invention relates to a light source, and more particularly, to a field emission light source for illumination.

DESCRIPTION OF RELATED ART

One common type of a light source is a fluorescent tube. It has many advantages, but suffers from serious drawbacks. For example, there is always a delay after the power has been turned on until it starts to operate giving full light. It needs complicated control equipment, which requires space. To obtain light with a source of this kind it is unfortunately necessary to use materials having negative environmental effects. It is for example a big disadvantage that mercury has to be used in this type of light sources.

A cathodolumninescent light source is another type of the light source. Such light source generally includes an evacuated envelope containing a grid and a heated cathode, for emission of electrons. A layer of phosphor is formed on an inside of the envelope. These cathodoluminescent lamps have essentially the form of an electric bulb. However, since these light sources all have a heated cathode, the cathode has to be heated by special means, before the emission of light starts. The use of electrons exciting phosphor to luminescence has the effect that more heat is produced. It is therefore necessary to dissipate the more heat effectively for getting a longer lifetime of the whole lamp.

Light emitting diodes are a kind of point light sources. It has certain advantages such as small size, no delay. But its illuminous efficiency is low.

Further, all of the above-mentioned light sources have a common shortcoming that they cannot provide a satisfactory high light brightness and uniformity. In order to achieve a higher uniform brightness using such lamps, a higher voltage or more light sources would have to be required. Therefore, energy consumption is undesirably increased accordingly.

What is desired is a clean light source that is able to achieve a high uniform brightness without undesirably requiring an increase in energy consumption.

SUMMARY OF INVENTION

A field emission light source for illumination provided herein generally includes: a cathode; a base having at least one isolating supporter disposed on the cathode, the isolating supporter containing silicon carbon; at least one field emitter containing molybdenum, each field emitter being formed on a respective isolating supporter of the base; and a light-permeable anode arranged over and facing the field emitter.

The isolating supporter may include an isolating layer.

The isolating supporter may alternatively include an isolating post. Preferably, the isolating post and the field emitter have a total length ranging from about 100 nanometers to about 2000 nanometers.

In addition, the isolating post may have a diameter ranging from about 10 nanometers to about 100 nanometers. Furthermore, the isolating post may be, e.g., cylindrical, conical, annular, or parallelepiped-shaped.

The field emitter preferably has a diameter ranging from about 0.5 nanometers to 10 nanometers.

The base may further include an electrically conductive connecting portion configured for establishing an electrically conductive connection between the field emitter and the cathode. Further, the isolating supporter may include a through hole, with the electrically conductive connecting portion received therein.

The field emission light source may further include a nucleation layer interposed between the cathode and the base. Further, the nucleation layer may advantageously be made of silicon and preferably has a thickness in the range from about 2 nanometers to about 10 nanometers.

These and other features, aspects, and advantages of the present backlight device will become more apparent from the following detailed description and claims, and the accompanying drawings.

BRIEF DESCRIPTION OF DRAWINGS

Many aspects of the present backlight device can be better understood with reference to the following drawings. The components in the drawings are not necessarily to scale, the emphasis instead being placed upon clearly illustrating the principles of the present backlight device. Moreover, in the drawings, like reference numerals designate corresponding parts throughout the several views.

DETAILED DESCRIPTION

Figure 1:
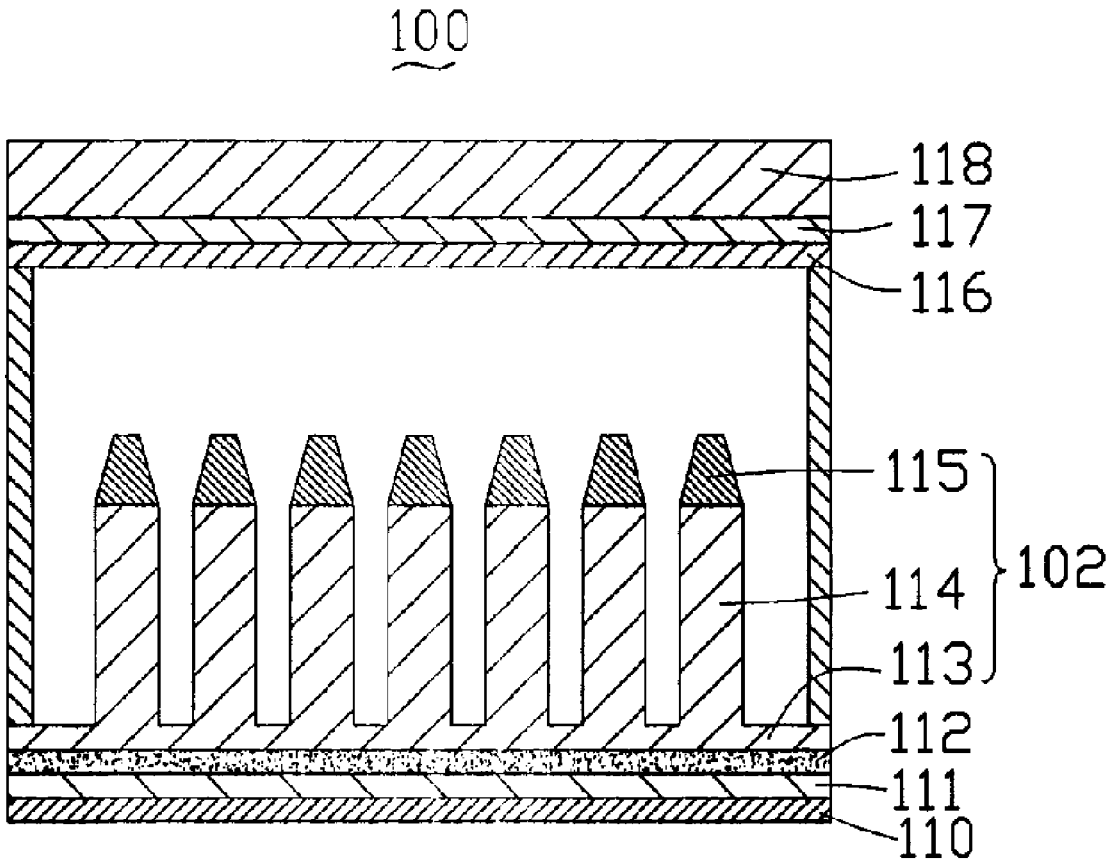
FIG. 1 is a schematic, perspective view of a light source, in accordance with a first embodiment.

FIG. 1 shows a field emission light source 100 in accordance with a first embodiment. The field emission light source 100 generally includes a cathode 111; a nucleation layer 112 formed on the cathode 111; a field emission portion 102 formed on the nucleation layer 112; and a light-permeable anode 117 arranged over the cathode 111. Spacers (not shown) may be interposed between the cathode 111 and the anode 117. The cathode 111 and the anode 117 cooperatively form a chamber therebetween that is advantageously evacuated to form a suitable level of vacuum (i.e., a level conducive to the free movement of electrons therethrough).

The anode 117 is generally a transparent conductive layer disposed on a front substrate 118, the front substrate 118 being made, e.g., of a glass or plastic material. The anode 117 is advantageously made of indium-tin oxide. At least one fluorescent layer 116 is formed on the anode 117 and faces the field emission portion 102. The anode 117 and the front substrate 118 are beneficially highly transparent or at least highly translucent to permit most of the light generated by the at least one fluorescent layer 116 to emit therethrough.

The cathode 111 is generally a conductive layer disposed on a rear substrate 110, the cathode 111 being made of one or more conductive metal materials, for example, gold, silver, copper, or their alloys. The rear substrate 110 can be made, e.g., of glass, plastic material, or metal.

The field emission portion 102 beneficially includes an isolating layer 113 formed on the cathode 111; a plurality of isolating posts 114 extending from the isolating layer 113; and a plurality of field emitters 115 formed on respective top ends of the isolating posts 114.

The isolating posts 114 can be configured to be cylindrical, conical, annular, parallelepiped-shaped, or other suitable configurations. The isolating layer 113 and the isolating posts 114 are advantageously made of essentially the same material as that used for the isolating layer 113, such as silicon carbon, carbon nitride, diamond-like carbon, or the like. Further, the isolating layer 113 is advantageously integrally formed with the isolating posts 114.

The field emitters 115 are formed on the top ends of the isolating posts 114 and project toward the anode 117. The field emitters 115 are advantageously made of molybdenum nano-tip materials. For example, the field emitters 115 may be molybdenum nanorods, molybdenum nanotubes, or molybdenum nanoparticles. It is advantageous for the field emitter light source 100 that these molybdenum nano-tip materials have excellent field emission capability, good mechanical strength, and good Young's modulus. However, it is to be understood that field emitters 115 could be made of other emissive materials (e.g., carbon, or silicon) and/or could be otherwise configured of other shapes conducive to field emission generation.

The nucleation layer 112 is formed on the cathode 111, and the field emission portion 102 is, in turn, formed thereon. During manufacture, the nucleation layer 112 is utilized as a substrate for the depositing of the isolating layer 113 and the isolating posts 114 thereon. Thus, a material of the nucleation layer 112 should be chosen according to the materials of the isolating layer 113 and the isolating posts 114. For example, if the isolating layer 113 and the isolating posts 114 are both made of silicon carbon, the nucleation layer 112 is preferably made of silicon. The nucleation layer 112 is preferably configured to be as thin as possible. A thickness of the nucleation layer 112 is in the range from about 1 nanometer to about 100 nanometers. Preferably, the thickness of the nucleation layer 112 is in the range from about 2 nanometers to about 10 nanometers. The nucleation layer 112 is beneficially suitably conductive to facilitate conductance of electrons from the cathode 111 to the isolating layer 113/field emission portion 102.

Figure 2:
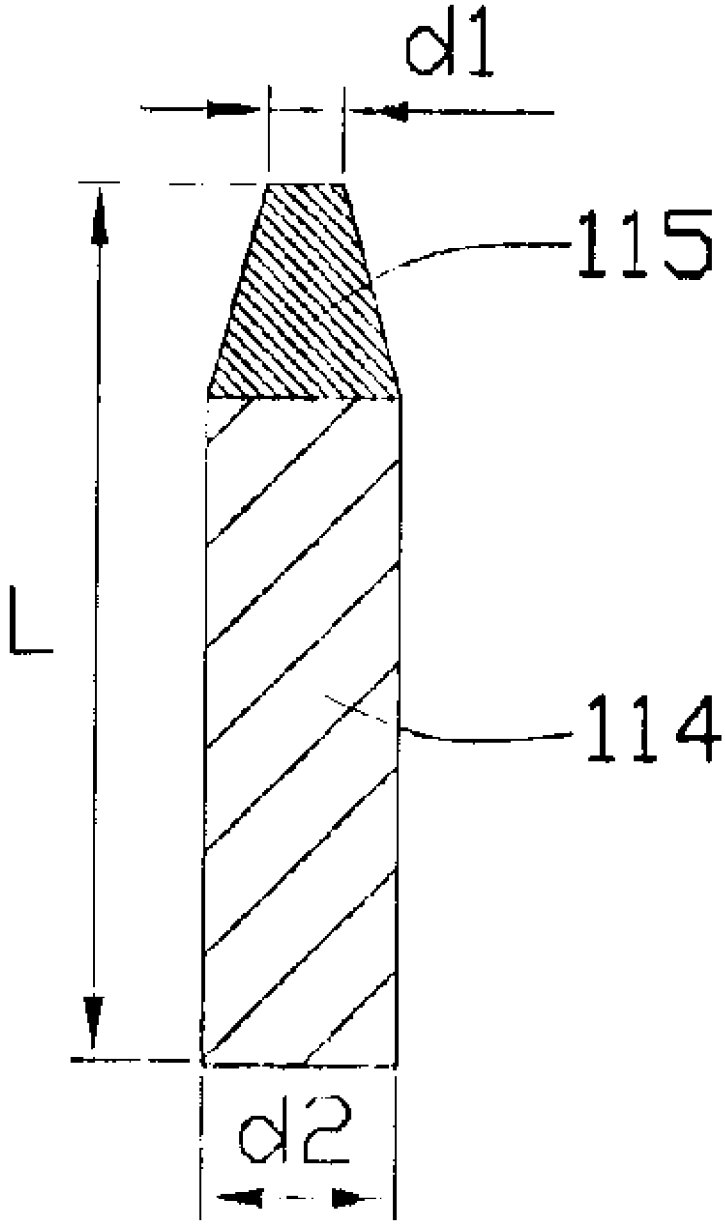
FIG. 2 is a schematic, enlarged view of a field emitter and its corresponding isolating post shown in the FIG. 1.

Referring to FIG. 2, in order to simplify the description of the first embodiment, a single exemplary isolating post 114 and a related field emitter 115 are described as follows. The isolating post 114 is advantageously configured to be cylindrical or in other suitable configurations and has a diameter (or width) d2 in the range from about 10 nanometers to about 100 nanometers. The field emitter 115 is advantageously configured to be in a form of a frustum or a cone. A base of the field emitter 115 opportunely has a diameter about equal to the diameter d2 of the isolating post 114. A top end of field emitter 115 has a diameter d1 in the range from about 0.5 nanometers to about 10 nanometers. A total length L of the isolating post 114 and the corresponding field emitter 115 is advantageously in the range from about 100 nanometers to about 2000 nanometers.

The field emission portion 102 may be manufactured by the steps of:

(1) providing a silicon substrate;

(2) forming a silicon carbon layer having a predetermined thickness thereof on the silicon substrate, the silicon carbon layer being formed by a chemical vapor deposition process, an ion-beam sputtering process, or otherwise;

(3) depositing a molybdenum layer on the silicon carbon layer; and (4) etching the molybdenum layer and the silicon carbon layer by a chemical etching process or otherwise, thereby obtaining the field emitter 115 and the isolating post 114. The silicon carbon layer may be utilized as the isolating layer 113.

In operation, electrons emitted from the field emitters 115 are, under an electric field applied by the cathode 111 and the anode 117, accelerated, and then collide with a fluorescent material of the fluorescent layer 116. The collision of the electrons upon the fluorescent layer 116 causes such layer 116 to fluoresce and thus emit light therefrom. The light passes through the anode 117 and the front substrate 118.

The field emission light source 100 is thin in size and light in weight and is capable of providing a high, uniform brightness. Energy consumption of the field emission light source 100 is relatively reduced. Particularly, the field emission light source 100 has a more stable structure and longer life. Moreover, with consideration of environmental protection, the field emission light source 100 is cleaner than the conventional fluorescent lamp.

Figure 3:
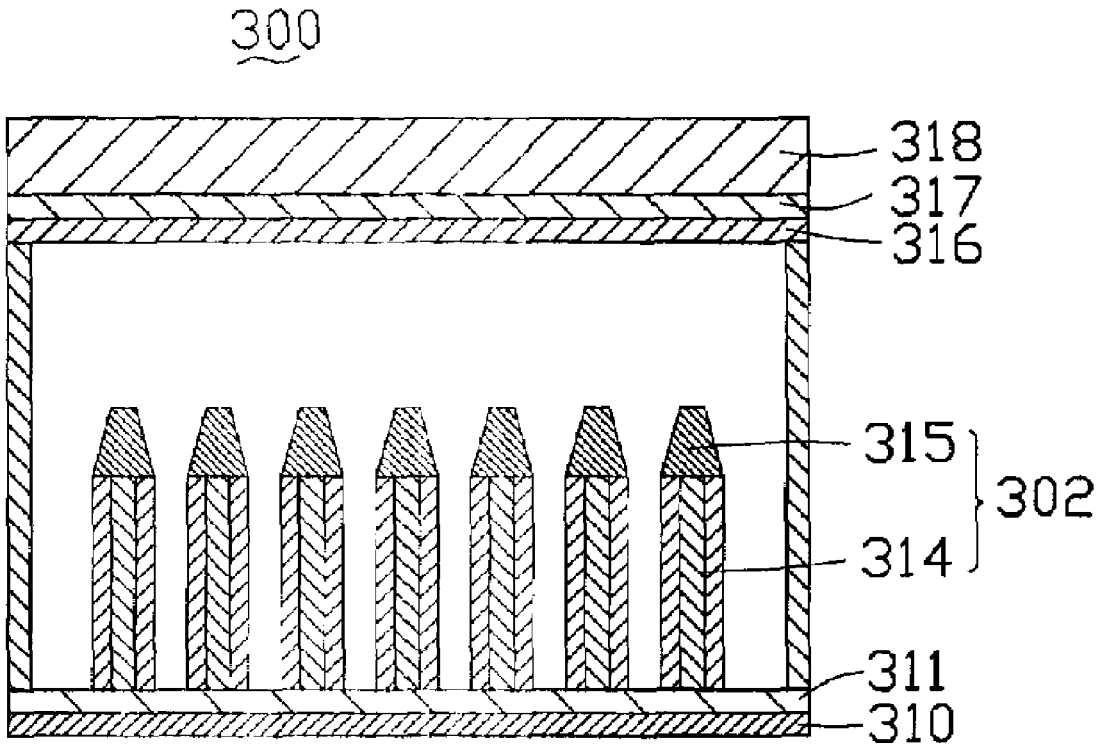
FIG. 3 is a schematic, perspective view of another light source, in accordance with a second embodiment.

FIG. 3 illustrates an alternative field emission light source 300, in accordance with a second embodiment. The field emission light source 300 includes a cathode 311 formed on a rear substrate 310; a field emission portion 302 formed on the cathode 311; and a light-permeable anode 317 arranged opposite to the cathode 311. The anode 117 is formed on a transparent front substrate 318. At least one fluorescent layer 316 is formed on the anode 317 and faces the cathode 311.

The field emission portion 302 includes a plurality of supporters 314 formed on the cathode 311; and a plurality of field emitters 315 formed on the supporters 314.

Figure 4:
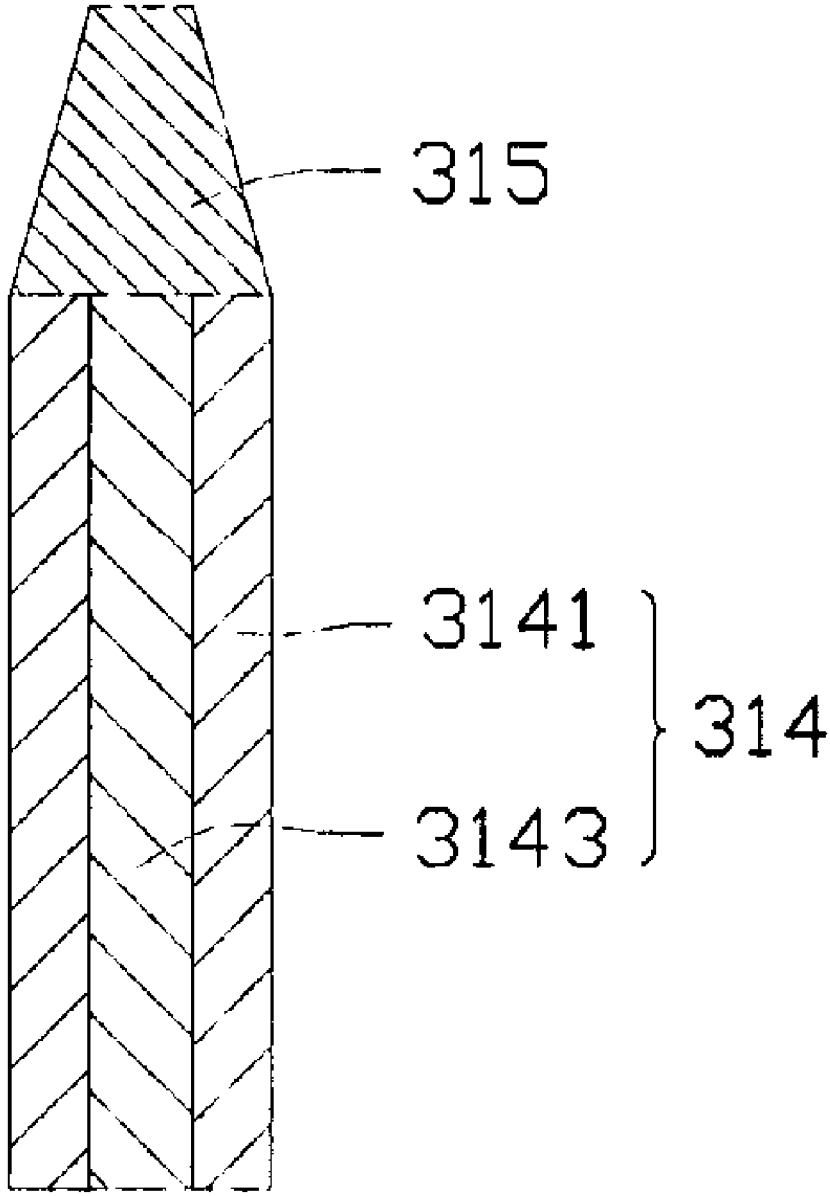
FIG. 4 is a schematic, enlarged view of a field emitter and its corresponding isolating post shown in the FIG. 3.

Referring to FIG. 4, a single exemplary supporter 314 and a corresponding field emitter 315 are described as follows. The supporter 314 of the second embodiment is similar to the isolating post 114 of the first embodiment, except that the supporter 314 includes a conductive core portion 3143 and an insulating enclosing portion 3141 surrounding the core portion 3143 therein. Further, the conductive core portion 3143 interconnects the cathode 311 and the corresponding field emitter 315. As such, the conductive core portion 3143 provides an electrically conductive connection between the cathode 311 and the corresponding field emitter 315.

In a process for manufacturing a supporter 314, a through hole is defined in a preformed solid insulating enclosing portion 3141. A conductive metal material, such as copper, gold, silver or their alloys, is then filled into the through hole of the insulating enclosing portion 3141, thereby obtaining the supporter 314. Alternatively, the conductive metal material could be first selectively deposited to form the core portions 3143 and then the material of the corresponding enclosing portions 3141 could be deposited therearound, either selectively to the desired surrounding shape or subsequently etched or otherwise shaped to a desired outer configuration.

Finally, while the present invention has been described with reference to particular embodiments, the description is illustrative of the invention and is not to be construed as limiting the invention. Therefore, various modifications can be made to the embodiments by those skilled in the art without departing from the true spirit and scope of the invention as defined by the appended claims.

What is claimed is:

1. A field emission light source comprising:

a cathode;

a base having at least one isolating supporter disposed on the cathode, the isolating supporter containing silicon carbon;

at least one field emitter containing molybdenum, each field emitter being formed on a respective isolating supporter of the base; and a light-permeable anode arranged over and facing the field emitter.

2. The field emission light source according to claim 1, wherein each isolating supporter includes an isolating layer.

3. The field emission light source according to claim 1, wherein each isolating supporter includes an isolating post.

4. The field emission light source according to claim 3, wherein each isolating post and the corresponding field emitter have a total length in the range from about 100 nanometers to about 2000 nanometers.

5. The field emission light source according to claim 3, wherein the isolating post is one of cylindrical, conical, annular, and parallelepiped-shaped.

6. The field emission light source according to claim 3, wherein the isolating post has at least one of a width and a diameter in the range from about 10 nanometers to about 100 nanometers.

7. The field emission light source according to claim 1, wherein the field emitter has a diameter in the range from about 0.5 nanometers to about 10 nanometers.

8. The field emission light source according to claim 1, wherein the base further includes an electrically conductive connecting portion configured for establishing an electrically conductive connection between the field emitter and the cathode.

9. The field emission light source according to claim 8, wherein the isolating supporter includes a through hole, and the electrically conductive connecting portion is received therein.

10. The field emission light source according to claim 1, wherein the light source further includes a nucleation layer sandwiched between the cathode and the base.

11. The field emission light source according to claim 10, wherein the nucleation layer is comprised of silicon.

12. The field emission light source according to claim 10, wherein the nucleation layer has a thickness in the range from about 2 nanometers to about 10 nanometers.

* * * * *